US009800963B1

(12) United States Patent
Liu et al.

(10) Patent No.: US 9,800,963 B1
(45) Date of Patent: Oct. 24, 2017

(54) SPEAKER DEVICE WITH FULL RANGE FREQUENCY AS WELL AS ENHANCEMENT OF BASS EFFECT AND ELECTRONIC DEVICE THEREWITH

(71) Applicant: ACER INCORPORATED, New Taipei (TW)

(72) Inventors: Feng-Ming Liu, New Taipei (TW); Jia-Ren Chang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 15/257,923

(22) Filed: Sep. 7, 2016

(30) Foreign Application Priority Data

May 13, 2016 (TW) ..... 105114883 A

(51) Int. Cl.
*H04R 1/20* (2006.01)
*H04R 1/02* (2006.01)
*H04R 1/28* (2006.01)

(52) U.S. Cl.
CPC ..... *H04R 1/021* (2013.01); *H04R 1/2811* (2013.01); *H04R 1/2819* (2013.01)

(58) Field of Classification Search
CPC ..... H04R 1/021; H04R 1/2811; H04R 1/2819
USPC ..... 381/337, 338, 340, 341, 350, 351; 181/155, 156, 199
See application file for complete search history.

(56) References Cited

U.S. PATENT DOCUMENTS 4,742,887 A * 5/1988 Yamagishi ..... H04R 1/22 181/129
5,004,066 A * 4/1991 Furukawa ..... H04R 1/2819 181/156
7,136,498 B1 * 11/2006 Schott ..... H04R 1/2842 381/351
2002/0099891 A1 * 7/2002 Cole ..... G06F 1/1616 710/200
2010/0135516 A1 * 6/2010 Saiki ..... H04R 1/2811 381/386
2010/0329496 A1 * 12/2010 Mottonen ..... H04M 1/035 381/349
2016/0295316 A1 * 10/2016 Shao ..... H04R 1/025

* cited by examiner

*Primary Examiner* — Tuan D Nguyen
(74) *Attorney, Agent, or Firm* — Winston Hsu

(57) ABSTRACT

A speaker device includes a resonant cabinet, a speaker unit and an inverted tube. The resonant cabinet is installed inside a device casing. A speaker chamber is defined between the resonant cabinet and the device casing and communicates with a plurality of first outlets formed on the device casing. The speaker unit is disposed inside the speaker chamber and for emitting a sound. A part of the sound is emitted from the plurality of first outlets by a first frequency via the speaker chamber. The inverted tube connects the resonant cabinet and the device casing. An inverted chamber is formed inside the inverted tube and communicates with the speaker chamber. Another part of the sound emits by a second frequency via the speaker chamber and the inverted chamber, wherein a peak value of the second frequency is smaller than a peak value of the first frequency.

14 Claims, 4 Drawing Sheets

SPEAKER DEVICE WITH FULL RANGE FREQUENCY AS WELL AS ENHANCEMENT OF BASS EFFECT AND ELECTRONIC DEVICE THEREWITH

BACKGROUND OF THE INVENTION

1. Field of the Invention

The present invention relates to a speaker device and an electronic device therewith, and more particularly, to a speaker device with full range frequency as well as enhancement of bass effect and an electronic device therewith.

2. Description of the Prior Art

With development of technology and advance of people's living standard, portable electronic devices, such as cell phones, tablet computers and so on, are implemented in not only work but also gaming industry, e.g., a gaming tablet is one of the products in the gaming market. Generally speaking, the gaming tablet is especially designed for facilitating handheld use and thus has constraint on volume thereof. However, the aforesaid constraint on volume of the gaming tablet further disadvantages designs of speaker and cabinet, so as to affect bass and soundstage generated by the speaker and the cabinet of the tablet computer. Accordingly, it reduces audio effect during gaming.

SUMMARY OF THE INVENTION

Thus, the present invention provides a speaker device and an electronic device therewith for solving above drawbacks.

According to an embodiment to the present invention, a speaker device with full range frequency as well as enhancement of bass effect is disclosed. The speaker device is installed in a device casing of an electronic device. The device casing has a first lateral wall and a second lateral wall connected to the first lateral wall. A plurality of first outlets are formed on the first lateral wall, and at least one second outlet is formed on the second lateral wall. The speaker device includes a resonant cabinet, a speaker unit and an inverted tube. The resonant cabinet is disposed inside the device casing. A speaker chamber is defined by the resonant cabinet and the device casing therebetween and communicates with the plurality of first outlets. The speaker unit is installed on the resonant cabinet and located inside the speaker chamber. The speaker unit is for generating a sound. A part of the sound passes through the speaker chamber and emits from the plurality of first outlets at a first frequency. The inverted tube connects the resonant cabinet and the second lateral wall of the device casing. An inverted chamber is formed inside the inverted tube and communicates with the speaker chamber and the at least one second outlet. Another part of the sound passes through the speaker chamber and the inverted chamber and emits from the at least one second outlet at a second frequency, wherein a peak value of the second frequency is smaller than a peak value of the first frequency.

According to another embodiment of the present invention, the inverted tube has an inverted top wall, an inverted bottom wall and a sound guiding wall. The inverted chamber is defined by the inverted top wall and the inverted bottom wall therebetween. The sound guiding wall is extended from the inverted top wall and stretches into the speaker chamber, so as to guide the other part of the sound into the inverted chamber from the speaker chamber.

According to another embodiment of the present invention, an edge of the sound guiding wall exceeds an edge of the inverted bottom wall, and the sound guiding wall covers part of the plurality of first outlets.

According to another embodiment of the present invention, the inverted tube is connected to the second lateral wall along an orientation of the inverted tube. The edge of the sound guiding wall is spaced from the edge of the inverted bottom wall by a first distance along the orientation of the inverted tube. The edge of the inverted bottom wall is spaced from the second lateral wall by a second distance along the orientation of the inverted tube, and the second distance is between 1 time of the first distance and 300 times of the first distance.

According to another embodiment of the present invention, a relation among a cross section area of the inverted chamber, the first distance, the second distance and the second frequency satisfy the Helmholtz formula.

According to another embodiment of the present invention, the speaker device further includes an inner wall. The inner wall protrudes from the first lateral wall and is connected to the resonant cabinet, the inner wall, the first lateral wall and the resonant cabinet cooperatively define the speaker chamber, the edge of the inverted bottom wall is spaced from the inner wall by a third distance along the orientation of the inverted tube, and the first distance is between 0.01 times of the third distance and 0.3 times of the third distance.

According to another embodiment of the present invention, a resonant chamber is formed inside the resonant cabinet, and the sound generated by the speaker unit is resonated by the resonant cabinet.

According to another embodiment of the present invention, an electronic device includes a device casing and a speaker device. The device casing has a first lateral wall and a second lateral wall connected to the first lateral wall. A plurality of first outlets are formed on the first lateral wall. At least one second outlet is formed on the second lateral wall. The speaker device includes a resonant cabinet, a speaker unit and an inverted tube. The resonant cabinet is disposed inside the device casing. A speaker chamber is defined by the resonant cabinet and the device casing therebetween and communicates with the plurality of first outlets. The speaker unit is installed on the resonant cabinet and located inside the speaker chamber. The speaker unit is for generating a sound. A part of the sound passes through the speaker chamber and emits from the plurality of first outlets at a first frequency. The inverted tube connects the resonant cabinet and the second lateral wall of the device casing. An inverted chamber is formed inside the inverted tube and communicates with the speaker chamber and the at least one second outlet. Another part of the sound passes through the speaker chamber and the inverted chamber and emits from the at least one second outlet at a second frequency, wherein a peak value of the second frequency is smaller than a peak value of the first frequency.

In summary, the present invention utilizes the inverted tube for not only allowing the part of the sound generated by the speaker unit to emit from the first outlets on the device casing at the first frequency, but also allowing the other part of the sound generated by the speaker unit to emit from the second outlet on the device casing at the second frequency, wherein the peak value of the second frequency is smaller than the peak value of the first frequency, and a treble portion of the second frequency is substantially identical to a treble portion of the first frequency. As a result, the characteristic of the sound generated by the speaker device of the present invention not only achieves enhancement of bass effect but also keeps the treble characteristic, so that it achieves performance for full range frequency.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
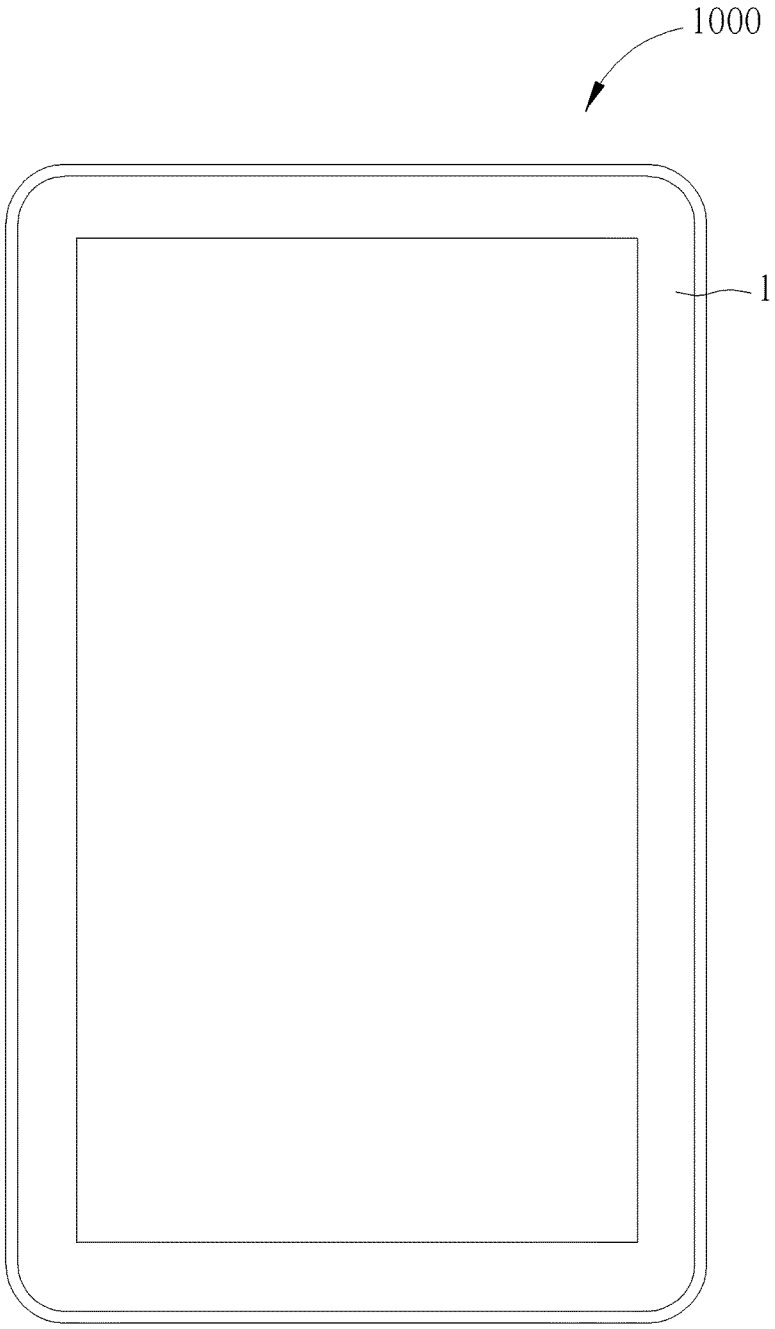
FIG. 1 is a diagram of an electronic device according to an embodiment of the present invention.
Figure 2:
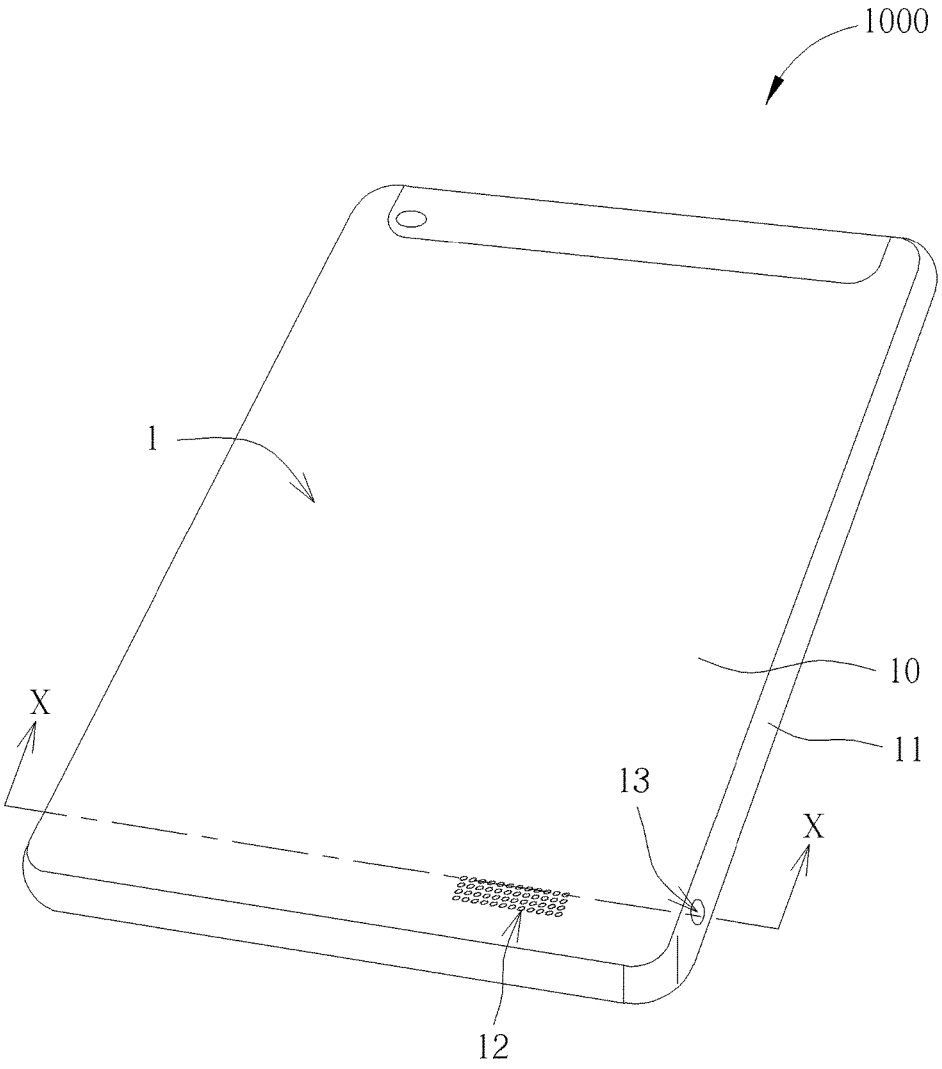
FIG. 2 is a diagram of the electronic device in another view according to the embodiment of the present invention.
Figure 3:
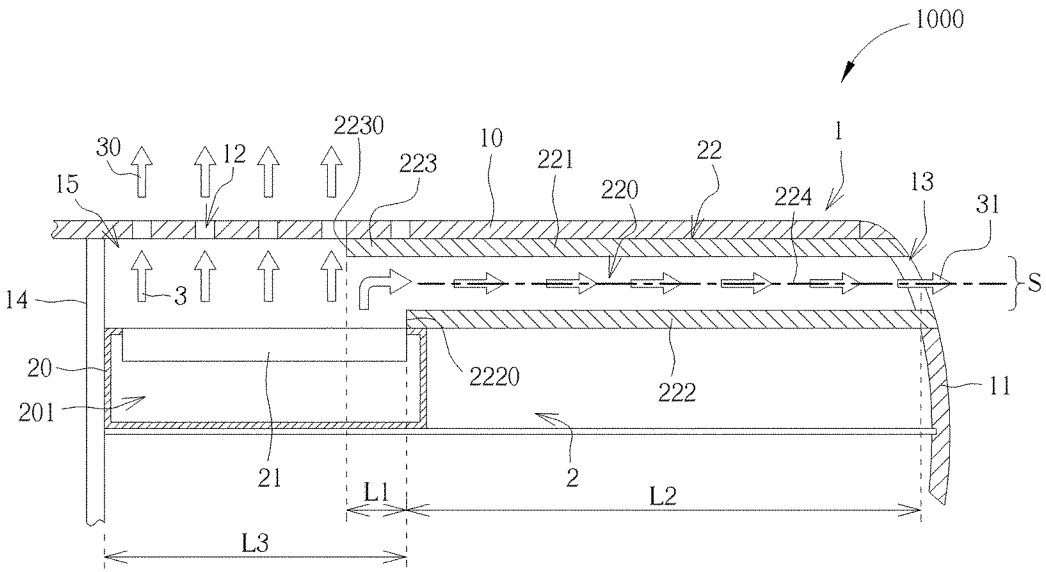
FIG. 3 is a sectional diagram of the electronic device taken along a section line X-X in FIG. 2.

FIG. 1 is a diagram of an electronic device 1000 according to an embodiment of the present invention. FIG. 2 is a diagram of the electronic device 1000 in another view according to the embodiment of the present invention. FIG. 3 is a sectional diagram of the electronic device 1000 taken along a section line X-X in FIG. 2. As shown in FIG. 1 to FIG. 3, the electronic device 1000 includes a device casing 1 and a speaker device 2, and the speaker device 2 is installed inside the device casing 1 and for generating a sound, so as to provide a user with an audio effect when the electronic device 1000 is in use. In this embodiment, the electronic device 1000 is a tablet computer, but the present invention is not limited thereto. For example, the electronic device 1000 can be a smart phone, a notebook computer and so on, and it depends on practical demands.

Furthermore, the device casing 1 has a first lateral wall 10, a second lateral wall 11 connected to the first lateral wall 10 and an inner wall 14 protruding from the first lateral wall 10, wherein the inner wall 14 is opposite to the second lateral wall 11. A plurality of first outlets 12 are formed on the first lateral wall 10. A second outlet 13 is formed on the second lateral wall 11. In this embodiment, the first lateral wall 10 can be a bottom casing portion of the electronic device 1000, and the second lateral wall 11 can be a lateral casing portion of the electronic device 1000. In other words, in this embodiment, the plurality of the first outlets 12 are formed on the bottom casing portion of the electronic device 1000, and the second outlet 13 is formed on the lateral casing portion of the electronic device 1000, but the present invention is not limited thereto. In addition, an amount of the second outlet 13 is not limited to those illustrated in figures in this embodiment. For example, the second lateral wall 11 can has the plural second outlets 13 formed thereon, i.e., structures that the second lateral wall 11 has at least one second outlet 13 formed thereon are within the scope of the present invention.

Furthermore, the speaker device 2 includes a resonant cabinet 20, a speaker unit 21 and an inverted tube 22. The resonant cabinet 20 is disposed inside the device casing 1. A speaker chamber 15 is defined by the resonant cabinet 20 and the device casing 1 therebetween and communicates the plurality of first outlets 12. In this embodiment, the inner wall 14 is further connected to the resonant cabinet 20. Thus, the inner wall 14 and the first lateral wall 10 of the device casing 1 and the resonant cabinet 20 cooperatively define the speaker chamber 15. Furthermore, the speaker unit 21 is installed on the resonant cabinet 20 and located inside the speaker chamber 15, and the speaker unit 21 is for generating a sound 3. A resonant chamber 201 is formed in the resonant cabinet 20. When the speaker unit 21 is electrified, the sound 3 generated by the speaker unit 21 resonates in the resonant chamber 201 and then transmitted into the speaker chamber 15 i.e., the speaker unit 21 utilizes the resonant chamber 201 for emitting the sound 3. In such a manner, a first part 30 of the sound 3 generated by the speaker unit 21 and resonated in the resonant chamber 201 is further emitted via the plurality of first outlets 12.

Furthermore, the inverted tube 22 connects the resonant cabinet 20 and the second lateral wall 11 of the device casing 1 along an orientation 224 of the inverted tube 22. An inverted chamber 220 is formed in the inverted tube 22 and communicates with the speaker chamber 15 and the second outlet 13. Furthermore, the inverted tube 22 has an inverted top wall 221, an inverted bottom wall 222 and a sound guiding wall 223, wherein the inverted chamber 220 is defined by the inverted top wall 221 and the inverted bottom wall 222 therebetween, and the sound guiding wall 223 is extended from the inverted top wall 221, i.e., an edge 2230 of the sound guiding wall 223 exceeds an edge 2220 of the inverted bottom wall 222. In this embodiment, the sound guiding wall 223 stretches into the speaker chamber 15 and covers part of the plurality of first outlets 12. In such a manner, when the speaker unit 21 utilizes the resonant chamber 201 to emit the sound 3, the sound guiding wall 223 is able to further guide a second part 31 of the sound 3 into the inverted chamber 220 from the speaker chamber 15, so that the second part 31 of the sound 3 passes through the inverted chamber 220 and emits from the second outlet 13.

In addition, the edge 2230 of the sound guiding wall 223 is spaced from the edge 2220 of the inverted bottom wall 222 by a first distance L1 along the orientation 224 of the inverted tube 22. The edge 2220 of the inverted bottom wall 222 is spaced from the second lateral wall 11 by a second distance L2 along the orientation 224 of the inverted tube 22.

The edge 2220 of the inverted bottom wall 222 is spaced from the inner wall 14 by a third distance L3 along the orientation 224 of the inverted tube 22, wherein the second distance L2 is between 1 time of the first distance L1 and 300 times of the first distance L1, and the first distance L1 is between 0.01 times of the third distance L3 and 0.3 times of the third distance L3. In other words, a relation among the first distance L1, the second distance L2 and the third distance L3 satisfy the following formula:

$$0.01*L3 \leq L1 \leq L1*0.3$$

$$1.0*L1 \leq L2 \leq 300*L1$$

Figure 4:
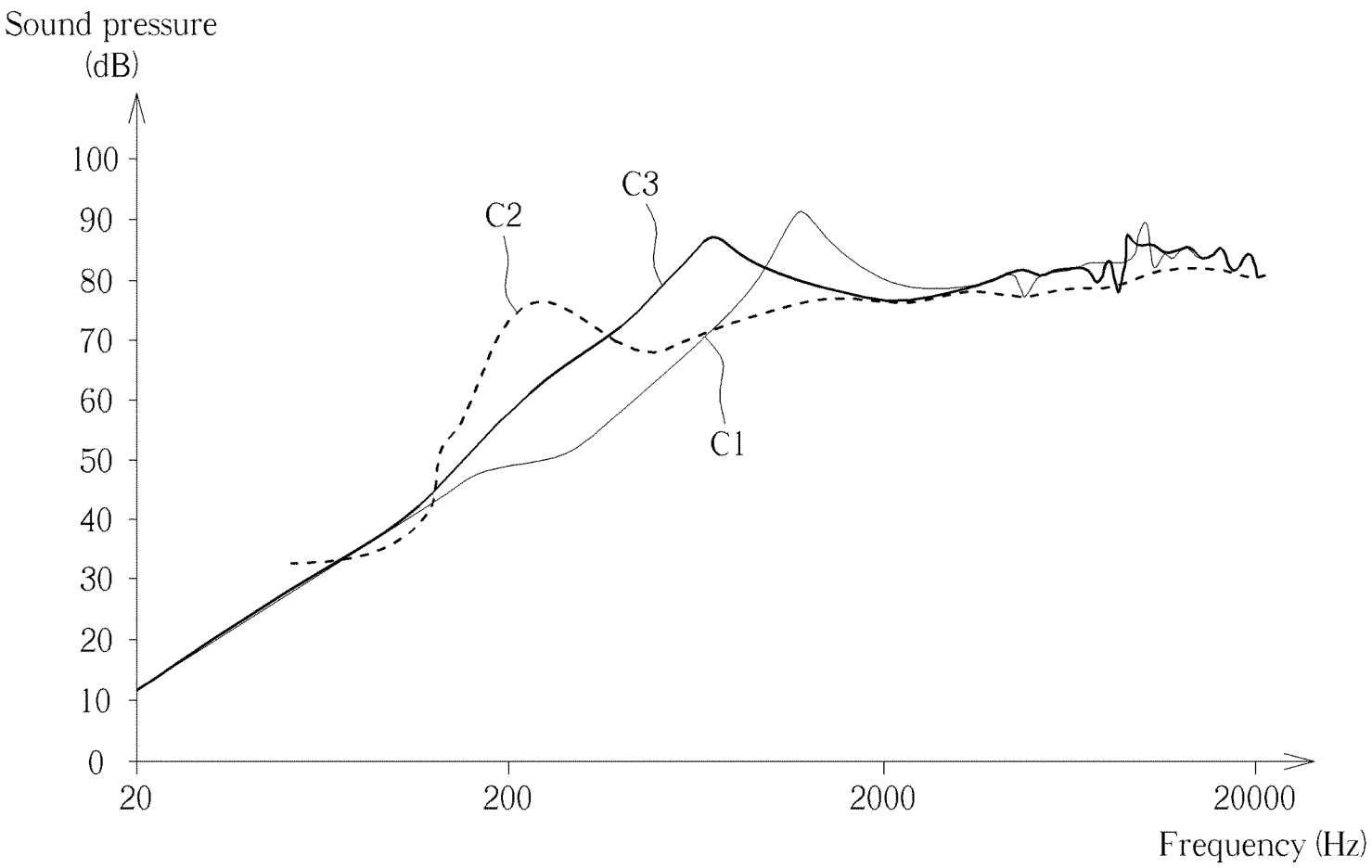
FIG. 4 is a diagram of a first frequency curve and a second frequency curve respectively corresponding to a first part and a second part of a sound generated by a speaker device according to the embodiment of the present invention.

FIG. 4 is a diagram of a first frequency curve C1 and a second frequency curve C2 respectively corresponding to the first part 30 and the second part 31 of the sound 3 generated by the speaker device 2 according to the embodiment of the present invention. As shown in FIG. 1 to FIG. 4, when the speaker unit 21 is electrified, a part (i.e., the first part 30) of the sound 3 generated by the speaker unit 21 passes through the speaker chamber 15 and emits from the plurality of first outlets 12 at a first frequency corresponding to the first frequency curve C1 shown in FIG. 4. Another part (i.e., the second part 31) of the sound 3 generated by the speaker unit 21 passes through the speaker chamber 15 and the inverted chamber 220 and emits from the second outlet 13 at a second frequency corresponding to the second frequency curve C2 shown in FIG. 4. As shown in FIG. 4, a peak value of the second frequency corresponding to the second part 31 of the sound 3 is smaller than a peak value of the first frequency corresponding to the first part 30 of the sound 3, i.e., the second frequency curve C2 corresponding to the second part 31 of the sound 3 shifts leftward relative to the first frequency curve C1 corresponding to the first part 30 of the sound 3. In such a manner, the speaker device 2 is able to emit a sound with characteristic of frequency corresponding to a third curve C3 shown in FIG. 4. It not only achieves enhancement of bass effect but also keeps the treble characteristic, so that it achieves performance for full range frequency.

It should be noticed that a cross section area S of the inverted chamber 220, the first distance L1, the second distance L2 and the second frequency satisfy the Helmholtz formula. In other words, the cross section area S, the first distance L1, the second distance L2 and the second frequency satisfy the following formula:

$$\text{The second frequency} = (\text{sound speed}/(2*\text{the circular ratio}))*\sqrt{\frac{\text{the cross section area } S}{\text{volume of cabinets}*(\text{the first distance } L1 + \text{the second distance } L2)}}$$

Compared to the prior art, the present invention utilizes the inverted tube for not only allowing the part of the sound generated by the speaker unit to emit from the first outlets on the device casing at the first frequency, but also allowing the other part of the sound generated by the speaker unit to emit from the second outlet on the device casing at the second frequency, wherein the peak value of the second frequency is smaller than the peak value of the first frequency, and a treble portion of the second frequency is substantially identical to a treble portion of the first frequency. As a result, the characteristic of the sound generated by the speaker device of the present invention not only achieves enhancement of bass effect but also keeps the treble characteristic, so that it achieves performance for full range frequency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A speaker device with full range frequency as well as enhancement of bass effect, installed in a device casing of an electronic device, the device casing having a first lateral wall and a second lateral wall connected to the first lateral wall, a plurality of first outlets being formed on the first lateral wall, at least one second outlet being formed on the second lateral wall, the speaker device comprising:

a resonant cabinet disposed inside the device casing, a speaker chamber being defined by the resonant cabinet and the device casing therebetween and communicating with the plurality of first outlets;

a speaker unit installed on the resonant cabinet and located inside the speaker chamber, the speaker unit being for generating a sound, a part of the sound passing through the speaker chamber and emitting from the plurality of first outlets at a first frequency; and an inverted tube connecting the resonant cabinet and the second lateral wall of the device casing, an inverted chamber being formed inside the inverted tube and communicating with the speaker chamber and the at least one second outlet, another part of the sound passing through the speaker chamber and the inverted chamber and emitting from the at least one second outlet at a second frequency, wherein a peak value of the second frequency is smaller than a peak value of the first frequency.

2. The speaker device of claim 1, wherein the inverted tube has an inverted top wall, an inverted bottom wall and a sound guiding wall, the inverted chamber is defined by the inverted top wall and the inverted bottom wall therebetween, the sound guiding wall is extended from the inverted top wall and stretches into the speaker chamber, so as to guide the other part of the sound into the inverted chamber from the speaker chamber.

3. The speaker device of claim 2, wherein an edge of the sound guiding wall exceeds an edge of the inverted bottom wall, and the sound guiding wall covers part of the plurality of first outlets.

4. The speaker device of claim 3, wherein the inverted tube is connected to the second lateral wall along an orientation of the inverted tube, the edge of the sound guiding wall is spaced from the edge of the inverted bottom wall by a first distance along the orientation of the inverted tube, the edge of the inverted bottom wall is spaced from the second lateral wall by a second distance along the orientation of the inverted tube, and the second distance is between 1 time of the first distance and 300 times of the first distance.

5. The speaker device of claim 4, wherein a relation among a cross section area of the inverted chamber, the first distance, the second distance and the second frequency satisfy the Helmholtz formula.

6. The speaker device of claim 4, further comprising:

an inner wall protruding from the first lateral wall and being connected to the resonant cabinet, the inner wall, the first lateral wall and the resonant cabinet cooperatively define the speaker chamber, the edge of the inverted bottom wall is spaced from the inner wall by a third distance along the orientation of the inverted tube, and the first distance is between 0.01 times of the third distance and 0.3 times of the third distance.

7. The speaker device of claim 1, wherein a resonant chamber is formed inside the resonant cabinet, and the sound generated by the speaker unit is resonated by the resonant cabinet.

8. An electronic device, comprising:

a device casing having a first lateral wall and a second lateral wall connected to the first lateral wall, a plurality of first outlets being formed on the first lateral wall, at least one second outlet being formed on the second lateral wall; and a speaker device, comprising:

a resonant cabinet disposed inside the device casing, a speaker chamber being defined by the resonant cabinet and the device casing therebetween and communicating with the plurality of first outlets;

a speaker unit installed on the resonant cabinet and located inside the speaker chamber, the speaker unit being for generating a sound, a part of the sound passing through the speaker chamber and emitting from the plurality of first outlets at a first frequency; and an inverted tube connecting the resonant cabinet and the second lateral wall of the device casing, an inverted chamber being formed inside the inverted tube and communicating with the speaker chamber and the at least one second outlet, another part of the sound passing through the speaker chamber and the inverted chamber and emitting from the at least one second outlet at a second frequency, wherein a peak value of the second frequency is smaller than a peak value of the first frequency.

9. The electronic device of claim 8, wherein the inverted tube has an inverted top wall, an inverted bottom wall and a sound guiding wall, the inverted chamber is defined by the inverted top wall and the inverted bottom wall therebetween, the sound guiding wall is extended from the inverted top wall and stretches into the speaker chamber, so as to guide the other part of the sound into the inverted chamber from the speaker chamber.

10. The electronic device of claim 9, wherein an edge of the sound guiding wall exceeds an edge of the inverted bottom wall, and the sound guiding wall covers part of the plurality of first outlets.

11. The electronic device of claim 10, wherein the inverted tube is connected to the second lateral wall along an orientation of the inverted tube, the edge of the sound guiding wall is spaced from the edge of the inverted bottom wall by a first distance along the orientation of the inverted tube, the edge of the inverted bottom wall is spaced from the second lateral wall by a second distance along the orientation of the inverted tube, and the second distance is between 1 time of the first distance and 300 times of the first distance.

12. The electronic device of claim 11, wherein a relation among a cross section area of the inverted chamber, the first distance, the second distance and the second frequency satisfy the Helmholtz formula.

13. The electronic device of claim 11, wherein the speaker device further comprises:

an inner wall protruding from the first lateral wall and being connected to the resonant cabinet, the inner wall, the first lateral wall and the resonant cabinet cooperatively define the speaker chamber, the edge of the inverted bottom wall is spaced from the inner wall by a third distance along the orientation of the inverted tube, and the first distance is between 0.01 times of the third distance and 0.3 times of the third distance.

14. The electronic device of claim 8, wherein a resonant chamber is formed inside the resonant cabinet, and the sound generated by the speaker unit is resonated by the resonant cabinet.

* * * * *